United States Patent [19]

Massa et al.

[11] Patent Number: 4,711,070

[45] Date of Patent: Dec. 8, 1987

[54] BAG PACKAGING MACHINE AND METHOD

[75] Inventors: Andre Massa, Mions; Guy Dupasquier, Villeurbanne, both of France

[73] Assignee: Atochem, France

[21] Appl. No.: 870,279

[22] PCT Filed: Aug. 13, 1985

[86] PCT No.: PCT/FR85/00219

§ 371 Date: Jun. 23, 1986

§ 102(e) Date: Jun. 23, 1986

[87] PCT Pub. No.: WO86/01486

PCT Pub. Date: Mar. 13, 1986

[30] Foreign Application Priority Data

Aug. 22, 1984 [FR] France ..... 84 13055

[51] Int. Cl.[4] ..... B65B 43/30

[52] U.S. Cl. ..... 53/573; 53/459

[58] Field of Search ..... 53/573, 571, 386, 459, 53/567; 493/125

[56] References Cited

U.S. PATENT DOCUMENTS 3,830,038 8/1974 Propst ..... 53/573 X
3,884,278 5/1975 Nakashima ..... 53/386 X
4,411,296 10/1983 Durant ..... 53/571 X
4,561,238 12/1985 Odom ..... 53/573

FOREIGN PATENT DOCUMENTS 1882954 11/1963 Fed. Rep. of Germany .
1533984 7/1968 France .

*Primary Examiner*—James F. Coan
*Attorney, Agent, or Firm*—Sigalos & Levine

[57] ABSTRACT

The present invention comprises a machine having a fixed portion and fitted with a plurality of pneumatic cylinders and pistons, at least one of said cylinders and pistons is activated by a nominal-pressure supply, and which at least one cylinder and piston forms part of a subassembly which moves with respect to the fixed portion of the machine. There is a counter-pressure system for each working phase of the subassembly cylinder, including means for counteracting the nominal-pressure supply to reduce jerking movements of the subassembly during operation. Also a speed-control unit which has a variable throttling valve and an anti-return valve is affixed to the fixed portion of the machine separated from the movable subassembly. Flexible lines are connected between the subassembly cylinder and the speed-control unit so that the mass of the movable subassembly is reduced to further reduce the jerking motion of the subassembly.

12 Claims, 9 Drawing Figures

BAG PACKAGING MACHINE AND METHOD

BACKGROUND OF THE INVENTION

This invention pertains to improvements to machines for packaging powdered products into valve bags.

Bags of this sort equipped with valves are generally placed flat in verticle or horizontal piles.

For automatic packaging of powdered products, it is usually necessary to open the valve of the bag located at the top of the pile, hold said bag and move it, with the valve open, from the storage area where the pile is located to a filling and weighing station comprising a distributor tube over which said valve must be placed.

Up to now, these operations were performed by applying, during their entire duration, a suction to the top of the first bag on the pile, using suction cups.

Experience has shown, however, that a certain percentage of valves did not open or opened incompletely, and that these bags were dropped, so that the operation of the packaging installation was defective.

It has been noted that this sometimes high percentage of failures was due in large measure to the shocks created in the bag-handling head by insufficient sophisticated design of the pneumatic control circuits and by inertia effects in the moving parts constituting the bag-grasping head subassembly.

SUMMARY OF THE INVENTION

The present invention overcomes these drawbacks by providing an apparatus and method for reducing the jerking motion of a cylinder subassembly.

Briefly, the present invention comprises a machine having a fixed portion and fitted with at least one pneumatic cylinder and piston which is activated by a nominal-pressure supply and forms part of a subassembly which is movable with respect to the machine. There is a counter-pressure system for each working phase of the subassembly cylinder, including means for counteracting the nominal-pressure supply to reduce jerking movements of the subassembly during operation. Also a speed control unit which has a variable throttling valve and an anti-return valve is affixed to the fixed portion of the machine separated from the movable subassembly. Flexible lines are connected between the subassembly cylinder and the control unit so that the mass of the movable subassembly is reduced to further reduce the jerking motion of the subassembly.

The invention also relates to a method of reducing the jerking movements of a valve bag bagging machine having a fixed portion and having at least one movable pneumatic cylinder and piston for effectuating movement using a first air supply pressure. The method comprises the steps of producing a second air supply at a pressure lower than the first air supply pressure, providing the first air supply pressure to one face of the piston and the second air supply pressure to the opposite face of the piston for initiating movement of the piston in the direction of the second face, providing the second pressure to both sides of the piston to slow the movement of the piston near the end of travel in the cylinder, progressively relieving pressure from the second side of the piston to permit travel of the piston to a given stop position, providing the first pressure to the second face of the piston after a time delay for initiating movement of the piston in the direction of the first face, and minimizing the mass of components attached to the piston for movement thereby.

BRIEF DESCRIPTION OF THE DRAWINGS

The attached figures also present the various characteristics and advantages of the invention and in which:

FIG. 1*a* is a perspective view of the stacked bags, FIG. 1*b* is a perspective view showing the top valve bag being grasped, FIG. 1*c* is a side view of a grasping head grasping a bag for opening, FIG. 1*d* is a perspective view of a grasping head moving a bag to a position for filling, FIG. 1*e* is a side view of the grasping head holding a bag in position for filling, FIG. 1*f* is a perspective view of the grasping head returned for grasping another bag as a filled bag is removed.

DETAILED DESCRIPTION

The general context of the invention, as will be described below with particular reference to the drawings, relates to reduction of the shocks to which the empty bags are subjected during handling, it has thus been possible to find solutions leading to a reduction of the moving mass either by using lighter structural materials than those used for the construction of the heads of conventional machines (in cases where this is allowed by the mechanical operation of the parts being replaced) or by elimination from the moving parts of various control accessories which were unnecessarily weighing them down, and other solutions involving increasing the flexibility of the movements of the bag-handling mechanism by using improved electropneumatic systems and creating capacity-buffers in the pneumatic control circuit.

More specifically, the invention pertains to a machine equipped with a plurality of pneumatic cylinders, certain of them forming part of a subassembly which moves with respect to the machine, characterized by the fact that jerking is eliminated by recourse to at least one of the following solutions:

- reducing the mass of the moving subassembly which rotates and translates,
- inserting flexible tubing between the cylinders on the one hand and the speed-control devices (variable throttling valves and anti-return valves) which are located to the fixed parts of the machine,
- creation during each operating phase (excluding approach) of counterpressure in the cylinders which form part of the moving subassembly.

More specifically, the invention envisions a machine such as the one defined above which can be used to place bags on a valve-bag bagger. In such a machine, the moving subassembly consists of a bag-grasping head.

DESCRIPTION OF THE PREFERRED EMBODIMENTS

Figure 1A:
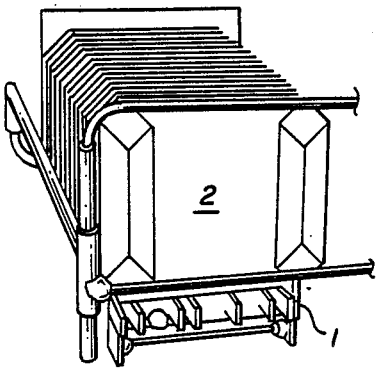
FIGS. 1*a–f* are a series of views showing the six phases of the movements of a bag-placer mechanism.

As seen from FIG. 1*a*, a supply of empty valve bags 2 is placed on the storage-area rack 1. This action is the only operation which is done manually; the rest of the cycle occurs automatically.

Figure 1B:
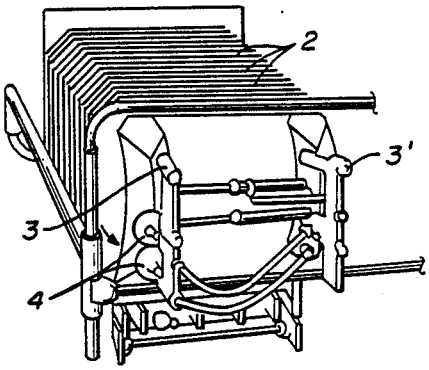

FIG. 1*b* shows the first sack or valve bag on the pile being grasped by the bag extraction system consisting of suction-cup support forks 3, 3' bearing telescoping suction cups 4, 4'. The telescoping suction cups are aspiration suction cups made of an elastomeric material, which the applicant has found to be more advantageous than ordinary suction cups for the purpose of extracting bags from the storage area, since they adapt themselves better to irregularities in the flatness and apparent hardness of the pile of bags, and since during transport of the bag, their shock-absorbing capability reduces the number of bags dropped due to shock.

Figure 1C:
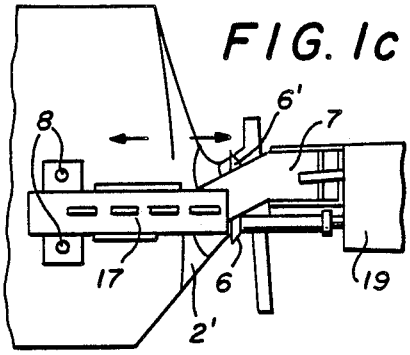

FIG. 1*c* shows the bag being taken over by the bag-grasping head which consists of elements 7, 8, 14, and 17 as described below with reference to FIG. 1*d*. The bag-grasping head is swung horizontally by the rotation actuator 5 (shown in FIG. 2). The bag-holding jaws 8 have closed over the bag. These are carried on articulated arms 7 and consist of solid cylinders 8 made of elastomeric material fitted into supports 17. The suction cups 6, 6' have not yet been actuated to open the valve 2'.

Figure 1D:
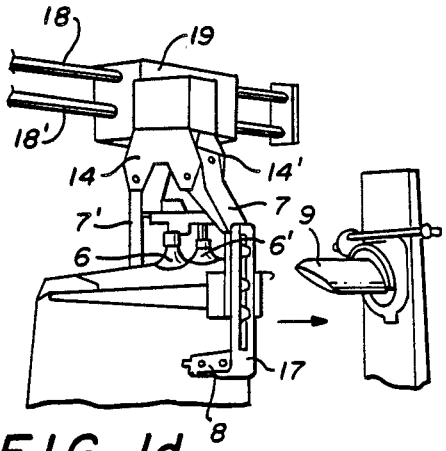

In FIG. 1*d*, the rotation actuator has brought the entire head to a vertical position, and the jaws 8 are keeping the sack beneath the head in a vertical position, the suction cups 6, 6' having acted to open the valve 2'. This figure shows the simplified design of the grasping head, which consists of two flanges front and back 14, 14' and two arms left and right 7, 7' to which the supports 17 for the jaws 8 are attached.

Figure 1E:
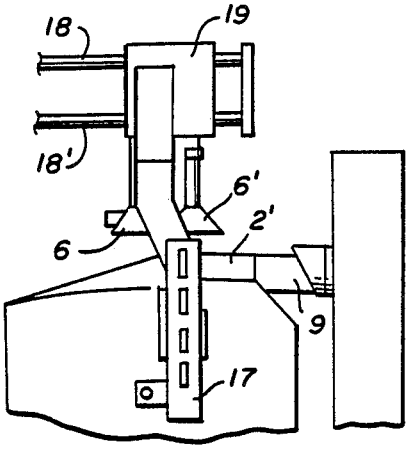

The insertion carriage 19 moves in a sliding fashion along the columns 18, 18' and causes the valve 2' of the bag to fit over the filler nozzle 9 on the metering installation (not shown), as seen in FIG. 1*e*.

Figure 1F:
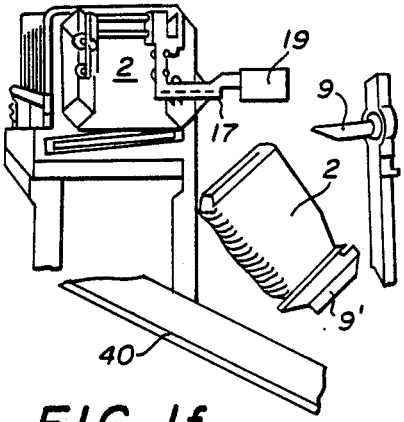

In FIG. 1*f*, the filled bag is mechanically ejected from the nozzle 9 and falls onto the swinging receptacle 9', which carries it back to a conveyor belt 40, while the grasping head 19, 17, which has returned to the horizontal position, returns to bring the next empty valve bag from the pile.

Figure 2:
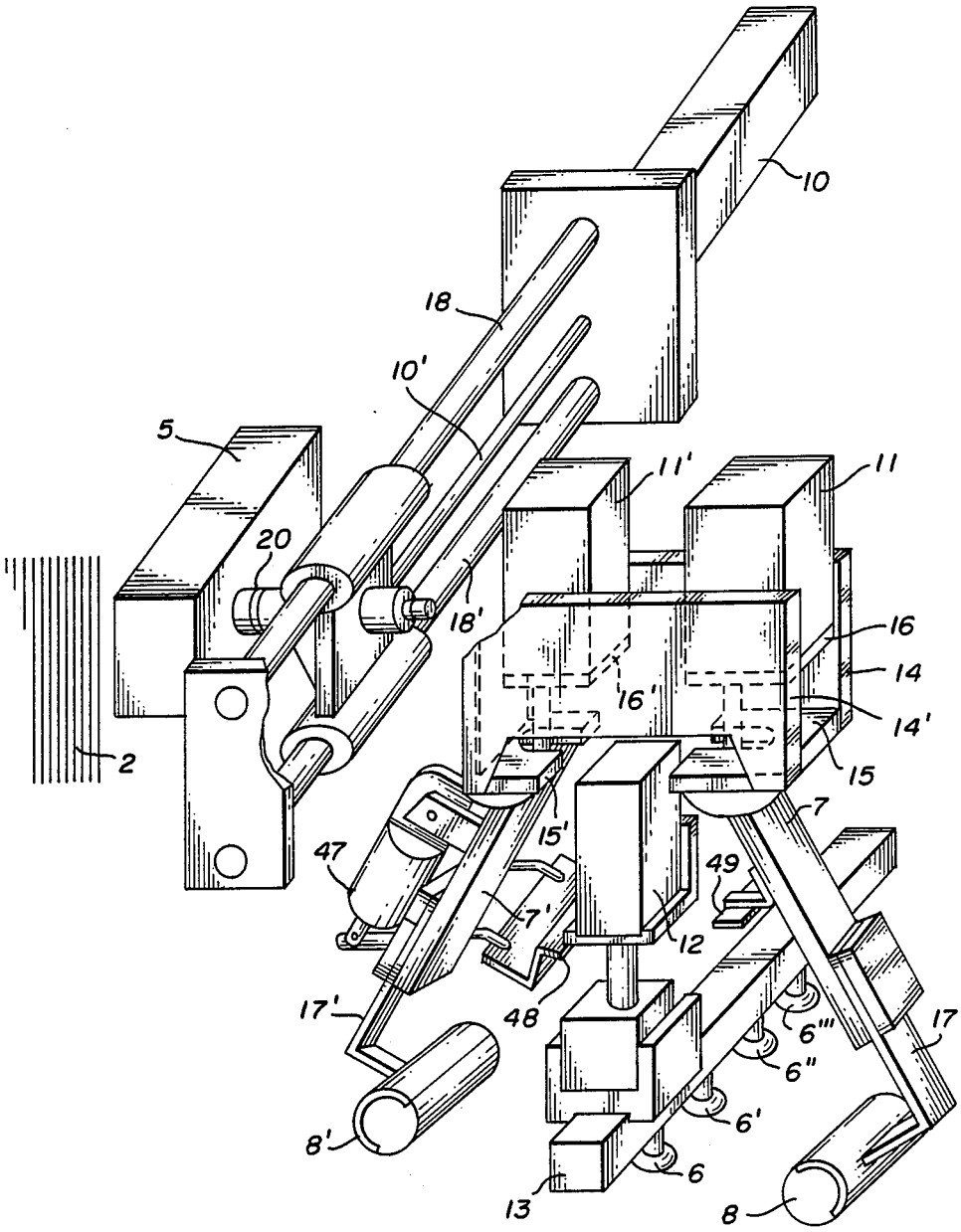
FIG. 2 is a perspective view of the component parts of the inventive bag-grasping head subassembly.

FIG. 2 shows the design of the grasping head in more detail, illustrating, at larger scale, the component parts already mentioned. The storage area for empty bags is located at 2.

The rotating actuator is located at 5. This is a hydraulic element which converts a translation motion into a rotation motion in collaboration with a rack and pinion system.

The rotating oscillating assembly constituting the grasping head proper hangs from and is wedged onto the rotating shaft 20 which emerges from 5.

This assembly comprises a cylinder 10 to advance the bag-insertion carriage and its rod 10'.

The carriage slides on two columns 18, 18'. The bags are grasped by a pair of jaws 8, 8', the opening and closing of which are controlled by cylinders 11, 11'. These cylinders are mounted on an assembly of flanges 14, 14' and braces 15, 15', 16, 16', assembled rigidly to form a sort of cage which constitutes the frame of the insertion carriage.

Articulated to this cage are the arms 7, 7' and their extensions 17, 17' which act as supports for the jaws 8, 8'.

Suspended from the same insertion carriage is a bar 13 bearing suction cups 6, 6', 6'', 6''' to open the valve.

These suction cups are connected to a vacuum source (not shown), and their support, namely the bar 13, is raised and lowered by the cylinder 12.

It is evident that the number of component parts in the head is high, and that the suspended mass which rotates alternately around the axis 20 and moves alternately in translation parallel to the columns 18, 18' and the rods of the cylinders 11, 11', 12 is relatively large.

The alternating nature of these movements creates, at the end-points, jerking motions due to the inertia of the moving parts.

These jerks, present in machines of the prior art, are detrimental to proper grasping of the bags and also to the longevity of the machinery.

One of the objects of this invention consists in systematically lightening the moving equipment constituting the head of using a light alloy such as AU4G to produce the structural parts of the said head, such as the flanges 14, 14', the braces or gussets such as 15, 15', the insert carriage 19, the arms 7, 7' and their extensions 17, 17'.

The only remaining steel parts are the rotation shafts for the arms 7, the pivoting shaft for the head 20, the corresponding bearing journals and, in general, those parts which must undergo high mechanical loads.

Another characteristic of the invention, also contributing to the same purpose as the means above, consists in removing from the assembly constituting the moving mass of the head the variable throttle/anti-return valve blocks (one block for each supply line to the double-acting cylinders) and relocating them on the general structure of the pneumatic distributrion assembly to reduce the inertia effects involved. The applicant has discovered an additional advantage in connecting said throttle/valve blocks to their corresponding cylinders using long flexible lines, in that they introduce additional buffering capacity which makes the installation more flexible.

Figure 3:
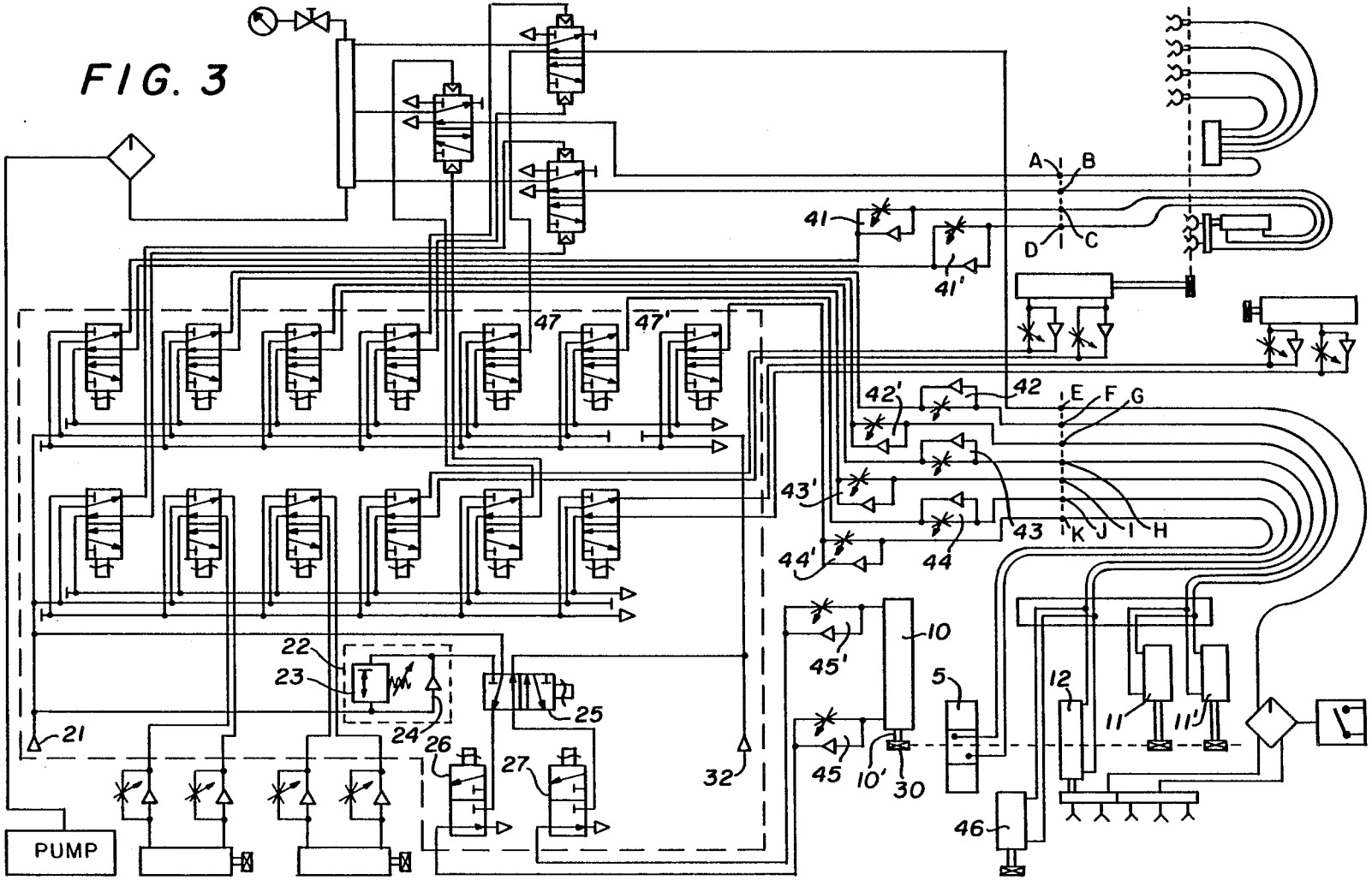
FIG. 3 is a schematic view of a portion of the pneumatic control circuit for the valve bag placer.

FIG. 3 shows the throttle/valve blocks at 41, 41', 42, 42', 43, 43', 44, 44'. These throttle/valve blocks are grouped together with the pneumatic assembly represented by the slide-valve distributors (not shown), and the degree of lightening that this creates in terms of the movable head assembly may be appreciated by noting that each assembly is usually made of a machined block of cast iron. The flexible line connections to the corresponding cylinders operating on the head 11, 11', 12, 46 and the rotating actuator 5 are made downstream of points A through K.

Finally, the principal characteristic of the invention involves installing, in counter-action to the nominal-pressure supply system, a counter-pressure system, said pressure being no more than three (3) bars less than the nominal pressure and, thanks to actions effected at suitable points in time, permitting end-of-travel cushioning of the masses constituting the bagger head, moved by the translation and rotation cylinders. At the usual working rates of modern baggers, which reach values between 800 and 1200 bags/hour, the corresponding cycle times are very short, between four and one-half (4.5) and three (3) seconds and are no longer within the response times of hydraulic accumulators which are limited by the viscosity of the oil.

The hydraulic accumulators thus become practically ineffective in their role as shock absorbers.

The idea which occurred was to supply the double-acting cylinders, at precise points during their forward and backward motion, determined by induction sensors, with compressed air at the two pressures of five (5) bars and three (3) bars (nominal pressure and counter-pressure), alternatively to the full cross section of the cylinder and the differential cross section of said cylinders. It must be understood that these values are given for purposes of illustration, and that the selection of other values would not go beyond the scope of the invention.

In this discussion, the full cross section S1 corresponds to the bore of the cylinder, and the differential cross section S2 is the preceding cross section minus the cross section of the cylinder rod.

Figure 4:
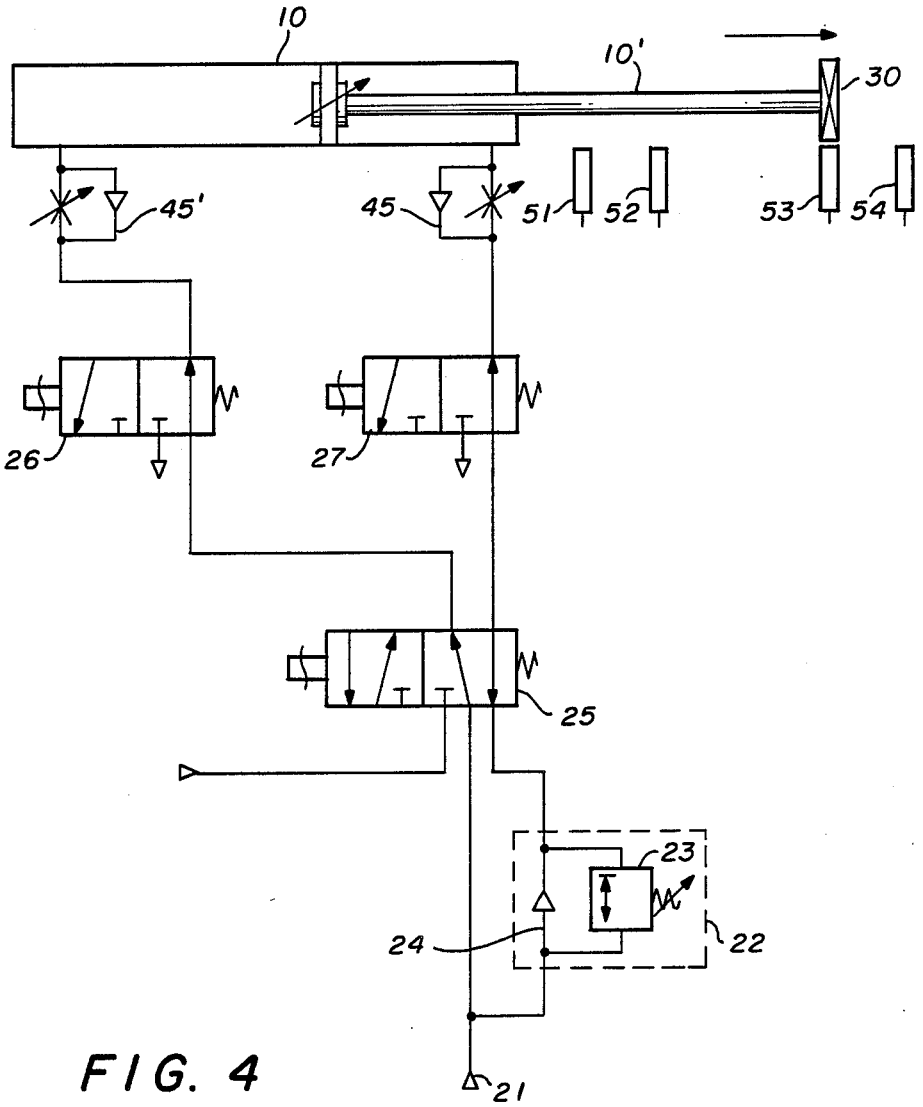
FIG. 4 is a schematic view of a pneumatic cylinder and piston and counter-pressure system.

A description of the movements of the cylinder 10 which causes the head to translate will provide a good illustration of the new principle embodied in the invention. These movements will be described with reference to FIG. 4.

This figure shows the translation cylinder 10, excluding the head and its attachments. The rod of the cylinder 10, 10' is equipped with a metal ring 30 designed to act upon the four detectors 51 to 54 as it passes them in succession.

Let us assume that, starting from rest, the ring 30 is located opposite detector 51. A timer, adjustable between zero and one second, instructs the head to transport a bag to the filling nozzle already referred to (9 in FIG. 1*d*), deactivates the detector 52 and activates 53. The distributors 25 (pilot distributor) and 26, 27 (working distributors) are in the "working" position (electromagnets energized). The nominal air pressure being produced by the source 21 is seen in two parallel circuits:

by means of distributor 26, it arrives at the rear of the cylinder 10 and acts on the full cross section S1 of its piston, having first passed through the speed-control blocks 45'. This block comprises, in conventional manner, an anti-return valve and a variable throttle, installed in parallel. In this case, according to the conventional representation, the valve operates in the open state, by means of distributor 27, through economizer 22, which consists of a pressure limiter 23 installed in parallel with an anti-return valve 24. This economizer controls both the pressure and the quantity of air admitted to the rear surface of the cylinder 10 and controls the degree of braking exerted on the cylinder by acting on the response time, which governs the braking. The larger the quantity of air admitted, the shorter the braking time and the more intense the braking. Braking occurs at the level of detector 53, and the movement ends at low speed from 53 to 54, where the cylinder reaches the forward stop position.

Since the cylinder 10 is of the shock-absorber type, its rod has a shoulder which blocks the normal compressed-air outlet from the front chamber, diverting the outlet flow to a smaller orifice and is equipped with a needle making it possible to adjust the outlet cross section and thus the abruptness of the approach over the last few centimeters of travel. The ring is then at the level of detector 54, which switches pressure by shutting off distributors 27 and 25, and thus sends the counter-pressure to the rear, while the front chamber is free to vent to the open air.

After an adjustable time interval, which in practice is on the order of a half-second, the distributor 27 switches to the working position and sends nominal pressure to the front of cylinder 10. The pressure difference between sections S1 and S2 then comes into play, and the piston 10' moves rapidly back until the ring passes in front of detector 52, which then switches distributor 26 to working position and sends counter-pressure to the rear surface S1.

After stoppage in the rear position and a time delay similar to the time delay in the rear stopped position, the movement can then be repeated.

The same principle of using a braking counter-pressure can be used for the operation of other translation or even rotation cylinders, such as cylinder 5.

This element is also called the "rotation actuator". It consists, in conventional fashion, of two cylinders connected by a common piston and operates by alternate admission of working fluid to the two end surfaces of its cylinders. The central portion of the common piston is configures as a rack, which meshes with a pinion, thus delivering a rotary motion to the output shaft 20 of said pinion.

It is this rotary motion which is transmitted to the bag-grasping head.

Referring to FIGS. 1*a* through 1*f*, we note that the alternating rotary movement can be broken down into two parts: an ascending part 1*d* and a descending part 1*f*.

The suspended masses have been reduced as much as possible, as described above. In addition, an effort has been made to balance these masses as much as possible about the axis 20. But it will be understood that, given the essentially different functions and characters of the parts constituting the bag-grasping head (cylinders, structural parts, arms, grabs), it was not possible to produce complete balancing of the assembly. These masses therefore give rise to an appreciable disequilibrium effect, and it is therefore understandable that the invention was extended to this rotation actuator cylinder 5, by having it operate as a motor in its ascending rotation phase (FIG. 1*d*) and as a brake during its descending rotation phase (FIG. 1*f*). This solution was arrived at by applying to cylinder 5 those measures described for the translation cylinder 10, by judicious application, mutatis mutandis, of the nominal pressure/-counter-pressure system.

This made it possible for the head to operate without jerking, which is a basic element in the operation of the bag placer.

To make the operation of the head in question totally reliable, it was found to be advantageous to add a function fulfilled by cylinder 47, which is also supplied in a conventional manner (FIG. 2).

This cylinder 47 mounted on the moving arm 17' actuates a structural bar 48 which acts together with a fixed structural bar 49 mounted on the moving arm 17 to ensure that the plane of the valve before it is opened by the suction cups 6 to 6''' is in fact perpendicular with the plane of the bag.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. In a machine having a fixed portion and fitted with at least one pneumatic cylinder and piston, which cylinder and piston is activated by a nominal-pressure supply and forms part of a subassembly which moves with respect to said fixed portion of the machine, the improvement comprising;

(a) a counter-pressure system for each working phase of said at least one cylinder and piston of said moving subassembly, including means for counteracting the nominal-pressure supply to said subassembly cylinder to reduce jerking movements thereof during operation;

(b) a speed-control unit for providing said nominal-pressure to said subassembly cylinder having a variable throttling valve and an anti-return valve for said subassembly cylinder, which speed-control unit is affixed to said fixed portion of said machine separate from said subassembly; and (c) flexible lines between said subassembly cylinder and said speed-control unit, thereby reducing the mass of said moving subassembly to further reduce jerking movements thereof during operation.

2. A machine for placing bags on a bagger for valve bags fitted with a plurality of pneumatic cylinders and pistons, at least one of which is activated by a nominal-pressure supply provided thereto and which at least one cylinder and piston forms part of a bag-grasping head subassembly which moves with respect to a fixed portion of the machine, comprising;

(a) a counter-pressure system for each working phase of said at least one cylinder and piston of said moving subassembly, including means for counteracting the nominal-pressure supply to said subassembly cylinder to reduce jerking movements thereof during operation;

(b) a speed-control unit for providing pressure to said subassembly cylinder and having a variable throttling valve and an anti-return valve for said subassembly cylinder, which speed-control unit is affixed to said fixed portion of said machine separate from said subassembly; and (c) flexible lines between said subassembly cylinder and said speed-control unit, thereby reducing the mass of said moving subassembly to further reduce jerking movements thereof during operation.

3. The machine of claim 2 having structural parts of said subassembly constructed of a light alloy such as AU4G, with the exception of the shafts, journal bearings and other parts subject to high stress, such that the rotating and translated mass of said subassembly is reduced, thereby further reducing jerking movements thereof during operation.

4. The machine of claim 2 wherein said flexible lines, which lines are inserted between said speed-control unit located on said fixed portion of said machine and said cylinder of said subassembly have sufficient volume to produce a buffer-capacitive effect.

5. The machine of claim 2 wherein said counter-pressure system further comprises:

(a) means for dampening the movements of said subassembly cylinder and piston at the end of the travel at the two extreme end points by placing a counter-pressure on the face of the piston opposite the face of the piston subject to said nominal pressure; and (b) means for producing time-delays between activation and pressure switching.

6. The machine of claim 5 wherein said means for dampening the movement of said cylinder at the ends of travel further comprises:

(a) means for creating a counter-pressure to be placed on the face of the piston opposite the face subject to said nominal pressure at the end of piston travel;

(b) electromagnetic pressure distributors for placing said created counter-pressure on said opposite face of said piston upon activation thereof;

(c) a ring attached solidly to the rod of said subassembly cylinder and piston;

(d) inductive detectors positioned along the path of cylinder and piston rod travel for switching said nominal-pressure and said counter-pressures by activating said electromagnetic pressure distributors upon detecting said ring; and (e) means for adjusting the distance between said detectors.

7. The machine of any of claims 2 to 6 characterized by the fact that the rotating movement of the bag-grasping head subassembly is achieved by means of a rotating actuator which acts as a motor in its ascenting phase and as a brake in its descending phase.

8. A machine such as a machine for placing bags on a bagger for valve bags comprising:

(a) first and second arms for holding an empty valve bag;

(b) a cylinder mounted on said first arm;

(c) a first structural bar which is actuated by said cylinder;

(d) a second structural bar mounted on said second arm and which acts together with said first structural bar and which second structural bar is immobile with respect to said second arm, to keep the plane of the valve of said valve bag, before it is opened, perpendicular to the plane of the empty bag which is held by said first and second arms.

9. A method of reducing the jerking movements of a valve bag bagging machine having a fixed portion and having at least one movable pneumatic cylinder and piston using a first air supply pressure through control components for effectuating movement, comprising the steps of:

(a) producing a second air supply at a pressure lower than said first air supply pressure;

(b) providing said first air supply pressure to one face of said piston and providing said second air supply pressure to the opposite face of said piston for initiating movement of said piston in the direction of said second face;

(c) providing said second pressure to both sides of said piston to slow the movement of said piston near the end of travel in said cylinder;

(d) progressively relieving pressure from said second side of said piston to permit travel of said piston to a given stop position;

(e) providing said first pressure to said second side of said piston after a time delay for initiating movement of said piston in the direction of said first face; and (f) minimizing the mass of movable subassembly components attached to said piston for movement thereby.

10. The method of claim 9 wherein the step of minimizing the mass comprises the steps of:

(a) moving control components from the movable cylinder and piston of said bagging machine to said fixed portion of said bagging machine; and (b) interconnecting said control components to said moving cylinder with flexible air pressure lines, thereby reducing the mass which must be moved by said cylinder to further reduce jerking.

11. The method of claim 10 further comprising the step of selecting flexible air pressure lines for interconnecting said control components to said moving cylinder with sufficient volume to provide a buffer-capacitive effect.

12. The method of claim 9 further comprising the step of constructing low stress structural components of said movable portion of said bagging machine out of a light weight alloy such as AU4G, thereby further reducing the movable mass to further reduce the jerking movement.

* * * * *